US006229972B1

(12) United States Patent
Rushing

(10) Patent No.: US 6,229,972 B1
(45) Date of Patent: May 8, 2001

(54) DIGITAL DENSITOMETER WITH CALIBRATION AND STATISTICS

(76) Inventor: Allen J. Rushing, 429 Tara La., Webster, NY (US) 14580

( * ) Notice: Subject to any disclaimer, the term of this patent is extended or adjusted under 35 U.S.C. 154(b) by 0 days.

(21) Appl. No.: 09/542,960

(22) Filed: Apr. 3, 2000

(51) Int. Cl.[7] ..... G03G 15/00
(52) U.S. Cl. ..... 399/74; 399/49
(58) Field of Search ..... 399/74, 31, 49, 399/72, 78; 250/559.1, 559.39

(56) References Cited

U.S. PATENT DOCUMENTS

| | | | | |
|---|---|---|---|---|
| 3,914,047 | * | 10/1975 | Hunt, Jr. et al. | 399/78 |
| 4,473,029 | | 9/1984 | Fritz et al. . | |
| 4,546,060 | | 10/1985 | Miskinis et al. . | |
| 4,553,033 | | 11/1985 | Hubble, III et al. . | |
| 5,075,725 | | 12/1991 | Rushing et al. . | |
| 5,122,835 | | 6/1992 | Rushing et al. . | |
| 5,402,361 | | 3/1995 | Peterson et al. . | |
| 5,649,266 | | 7/1997 | Rushing . | |
| 5,903,796 | | 5/1999 | Budnik et al. . | |
| 5,950,051 | | 9/1999 | Casella . | |
| 5,963,761 | | 10/1999 | Budnik et al. . | |
| 5,966,572 | | 10/1999 | Mishra et al. . | |
| 5,966,573 | | 10/1999 | Yu et al. . | |
| 5,995,802 | | 11/1999 | Mori et al. . | |

OTHER PUBLICATIONS

Walt Kester, "Practical Design Techniques for Sensor Signal Conditioning, Ch. 6, Position and Motion Sensors," 1999, Analog Devices, Inc., USA.

Arthur Gelb, Et Al, "Applied Optimal Estimation," 1974, M.I.T. Press, Cambridge, MA, USA.

"DAQCard™ —1200 User Manual," Feb. 1996, National Instruments Corp, Austin, TX, USA.

* cited by examiner

*Primary Examiner*—Joan Pendegrass

(57) ABSTRACT

A densitometer with built-in data processing capability uses synchronizing signals to collect data at defined spots on a moving endless belt or drum test sample. A calibration cycle accumulates data for later use in measurement correction. After correction, measurement data are output or stored for later output to a host processor or display device. Data averaging, filtering, smoothing, statistical functions, and pattern recognition are also provided by the densitometer circuitry.

15 Claims, 5 Drawing Sheets

DIGITAL DENSITOMETER WITH CALIBRATION AND STATISTICS

FIELD OF THE INVENTION

This invention relates generally to densitometers for measuring optical density. In particular, the invention relates to optical density measurement of toner-covered test patches, areas spanning a belt seam, or other areas for controlling process parameters in electrostatographic apparatus such as copiers and printers.

BACKGROUND OF THE INVENTION

In electrostatographic apparatus such as copiers and printers, automatic adjustment of process control parameters is used to produce images having well regulated darkness or optical density. Copier and printer process control strategies typically involve measuring the transmissive or reflective optical density of a toner image on an exposed and developed area (called a "test patch") of an image receiver. Optical density has the advantage, compared to transmittance or reflectance measures, of matching more closely to human visual perception. A further advantage, especially for transmission density, is that density is approximately proportional to the thickness of the marking material layer, over a substantial range.

Typically, toned process control test patches are formed on the photoconductor in interframe regions of the photoconductor, i.e., between image frame areas. An "on-board" densitometer measures the test patch density, either on the photoconductor or after transfer of the patches to another support member. From these measurements, the machine microprocessor can determine adjustments to the known operating process control parameters such as primary charger setpoint, exposure setpoint, toner concentration, and development bias.

A transmission type of densitometer is particularly well suited to transmissive supports. In this type, a light source projects light, visible or infrared, through an object onto a photodetector such as a photodiode. In a copier/printer, the photoconductor passes between the light source and the photodetector. When the photoconductor has toner on the surface, the amount of light reaching the photodetector is decreased, causing the output of the densitometer to change. Based on this output, the amount of toner applied to the photoconductor can be varied as required in order to obtain consistent image quality. Another type of densitometer as described in U.S. Pat. No. 4,553,033 to Hubble, III et al, uses reflected light flux rather than transmitted light flux to determine density, and is particularly suited to opaque reflective supports.

Typically, the copier/printer logic and control unit (LCU) is burdened with tasks that involve managing the data collection procedure and processing large amounts of raw density data presented to the LCU. To obtain a single net toner density measurement, the untoned base density must be measured, and then subtracted from the toned density measurement. The LCU must provide the proper timing signals for these readings, receive the readings, provide the necessary storage, and perform the subtraction. The untoned base density readings must be updated from time to time so that changes in the base or in the densitometer itself are properly accounted for. The base material may wear or otherwise change its optical transmission or reflection characteristics. The densitometer light emitter typically degrades with age, and the emitter and detector typically become contaminated, for example, with toner dust and paper dust.

U.S. Pat. No. 5,122,835 to Rushing et al discloses a process for measuring untoned areas during cycle-up and between image frames during imaging cycles, storing the readings, and subtracting the stored readings from subsequent readings. In this scheme, the densitometer provides individual density readings of defined spots on an image belt. The LCU coordinates the timing of these readings, stores readings, and performs the arithmetic operations to correct the raw density readings. These functions are in addition to the routine LCU functions of controlling the operation of the various printer workstations.

For process control purposes, individual density measurements are typically averaged, filtered, or otherwise mathematically processed in real-time. Such mathematical processing is often for the purpose of reducing the effects of various noise sources. This enables more precise operation of the process control, and better regulation of image quality. Noise may arise, for example, from toning nonuniformity or electrical noise coupled into the densitometer from other parts of the machine. Ordinary averaging of N noisy and uncorrelated readings can reduce the standard deviation, of the averages, by a factor of about $N^{1/2}$, compared to single readings.

An LCU must be provided with enough speed, memory, input/output capability, and software to provide these functions simultaneously with real-time control of the printer subsystems. U.S. Pat. No. 5,075,725 to Rushing et al, for example, discloses an electrophotographic process control utilizing averaging of multiple densitometer readings. Four readings are taken in each process control patch and averaged. Further real-time calculations determine adjustments to be applied to the electrophotographic process.

For test and diagnostic purposes, copier/printers typically provide special modes of operation to evaluate photoconductor uniformity, wear, electrical characteristics, and defects. Some evaluations may be based on surface potential readings from a non-contact voltmeter, and other evaluations based on densitometer readings. Each sensor collects multiple readings, from which statistics are computed such as mean (or average), median, mode, maximum, minimum, variance, standard deviation, root-mean-square, number of readings out-of-limit, etc., and then typically displayed for evaluation. Such statistics may characterize the entire circumference of the belt or drum, or only specific areas such as process control patches. U.S. Pat. No. 5,903,796 to Budnik et al evaluates photoconductors by this statistical approach. In the Budnik et al disclosure, densitometer readings are taken with a spacing of approximately 1.5 mm. Statistics are computed and used to determine acceptability of the photoconductor belt. The processing power of the LCU must be sufficient for these statistical tasks, along with the routine machine control.

Another disclosure by Budnik et al, in U.S. Pat. No. 5,963,761, collects noisy densitometer readings in the vicinity of the seam of an endless belt. The noisy readings are statistically processed to identify the precise location of the seam. Precise seam location is essential for proper timing of the image processing steps.

SUMMARY OF THE INVENTION

One object of the present densitometer invention is to provide measurements at defined spots on the moving photoconductor belt or other test sample in endless belt or drum form. In a preferred embodiment, an encoder is mechanically coupled to the belt or drum, and generates pulses corresponding to the test sample motion. The pulses are synchronous in that a fixed number of pulses occur for each test sample once-around. The pulses occur at times marking the movement of defined circumferential positions on the test sample past a fixed point. The pulses are used to trigger the density measurements at the appropriate times, that is, at the defined spots on the test sample.

Another object of the present invention is to provide automatic nulling out of a variable base density, based on frequently updated calibration cycle data. Nonuniformity, wear, and scumming of the base density, along with aging and contamination of the densitometer components could otherwise corrupt the densitometer measurements, degrade the copier/printer process control, and cause inconsistent image quality. The necessary data storage and subtraction are provided on the circuit board of the densitometer itself, rather than by the host processor or logic and control unit (LCU).

Yet another object of the present invention to provide averaging, filtering, smoothing, statistics, and pattern recognition of the density measurements. The circuitry and programming for these data processing operations are designed especially to reduce the influence of noise in the copier/printer process control. They are accomplished in real-time on the densitometer circuit board, then saved and made available to the host processor as needed. These functions would otherwise need to be provided by the host processor or LCU, with the requirement for extra host or LCU memory, speed, and software.

Still another object of the present invention to provide data logging or storage for density measurements. Substantial blocks of density measurements and statistics are accumulated over time and stored on the densitometer circuit board. These data are saved and presented to the host processor or LCU at specific designated or triggered times. Between these specific times, the host processor can better attend to time-critical machine control tasks.

To obtain these objects, a densitometer is disclosed using synchronizing signals to collect data at defined spots on a moving endless belt or drum test sample. A calibration cycle accumulates data for later use in measurement correction. After correction, measurement data are output or stored for later output to a host processor or display device. Data averaging, filtering, smoothing, statistical, and pattern recognition functions are also provided by the densitometer circuitry.

BRIEF DESCRIPTION OF THE DRAWINGS

The subsequent description of the preferred embodiment of the present invention refers to the attached drawings wherein.

DETAILED DESCRIPTION OF THE PREFERRED EMBODIMENT

I. Electrophotographic Printing Machine Environment

Because apparatus of the general type described herein are well known the present description will be directed in particular to elements forming part of, or cooperating more directly with, the present invention. While the invention will be described with reference to imaging apparatus and particularly to an electrophotographic system, the invention can also be used in other imaging apparatus and in environments not in the imaging field.

Figure 1:
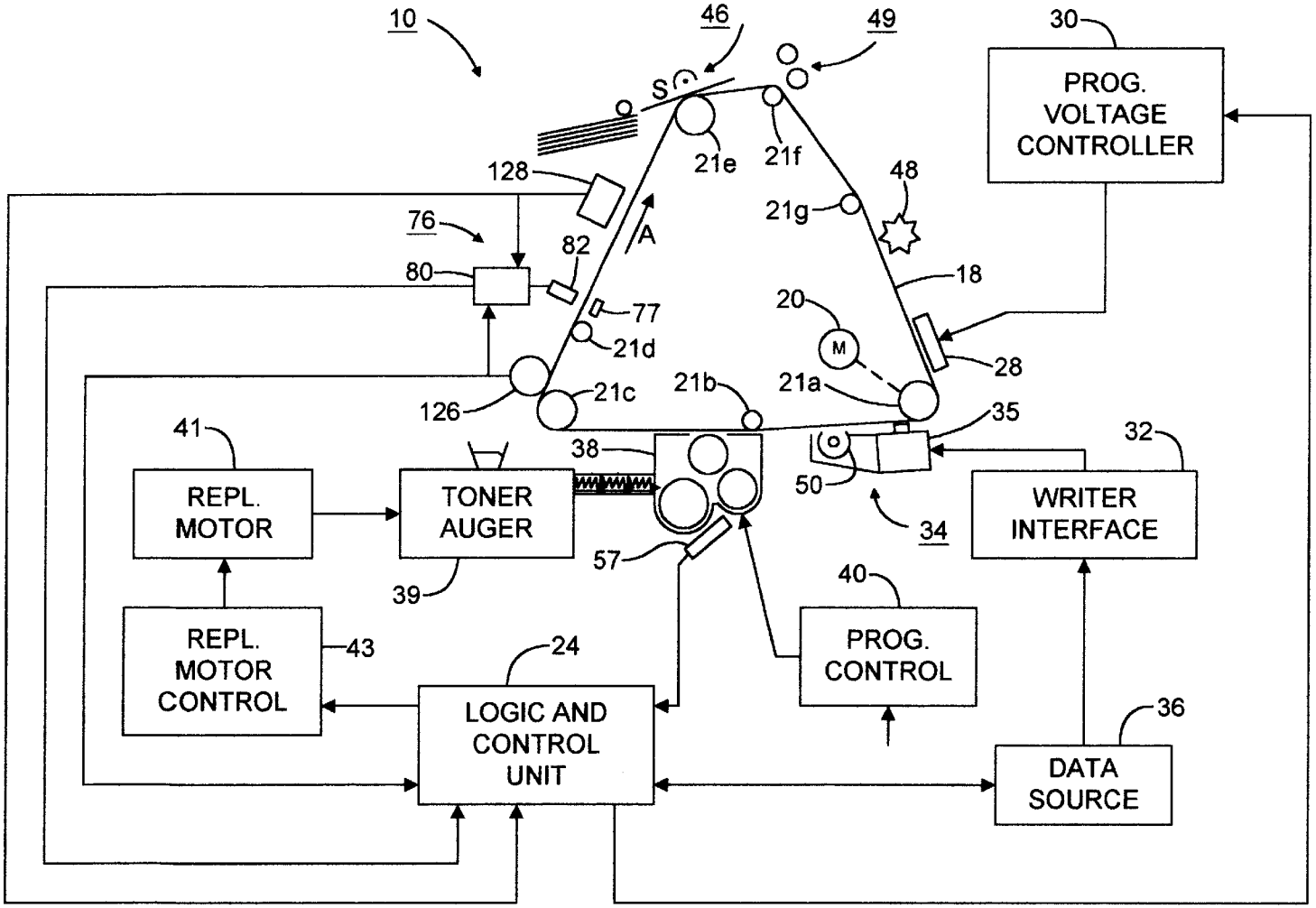
FIG. 1 is a side elevational view in schematic form of an electrophotographic apparatus to illustrate one environment for the use of this invention.

With reference to the electrophotographic copier and/or printer machine 10 as shown in FIG. 1, a moving image supporting structure such as photoconductor belt 18 is entrained about a plurality of rollers or other supports 21*a*–21*g*. Photoconductor belt 18 is a layered composite structure including a photoconductive layer, a ground layer, and a support layer. One or more of rollers 21*a*–21*g* are driven by a motor 20 so as to advance the belt in a direction indicated by an arrow "A" past a series of workstations of machine 10. A logic and control unit 24, which has a digital computer, has a stored program for sequentially actuating the workstations in response to signals from various sensors and encoders, as is well known.

A primary charging station 28 sensitizes belt 18 by applying a uniform electrostatic charge of predetermined primary voltage $V_0$ to the surface of the belt. The output of the charging station is regulated by a programmable voltage controller 30, which is in turn controlled by logic and control unit 24 to adjust primary voltage $V_0$ for example through control of electrical potential ($V_{grid}$) to a grid that controls movement of corona charges from charging wires to the surface of the recording member, as is well known. Other known forms of chargers, including roller chargers, may also be used.

At an exposure station 34, projected light from a write head 35 dissipates the electrostatic charge on the photoconductive belt to form a latent image of a document to be copied or printed. The write head preferably has an array of light-emitting diodes or other light source such as a laser or other spatial light modulator for exposing the photoconductive belt picture element (pixel) by picture element with a regulated intensity and exposure, $E_0$. Alternatively, the exposure may be by optical projection of an image of a document or a patch onto the photoconductor.

Where a light-emitting diode or other electro-optical exposure source or writer is used, image data for recording is provided by a data source 36 for generating electrical image signals. The data source 36 may be a computer, a document scanner, a memory, a data network, etc. Signals from the data source and/or logic and control unit may also provide control signals to a writer interface 32 for identifying exposure correction parameters in, for example, a LUT for use in controlling image density.

Travel of belt 18 brings the areas bearing the latent charge images into a development station 38. The development station has one (more if color) magnetic brushes in juxtaposition to, but spaced from, the travel path of the belt. Magnetic brush development stations are well known. For example, see U.S. Pat. No. 4,473,029 to Fritz et al and U.S. Pat. No. 4,546,060 to Miskinis et al. Other types of development stations may be used as is well known and plural development stations may be provided for developing images in plural colors or with toners of different physical characteristics.

Logic and control unit 24 selectively activates the development station in relation to the passage of the image areas containing latent images to selectively bring the magnetic brush into engagement with or a small spacing from the belt. Marking material in the form of charged toner particles of the engaged magnetic brush are attracted imagewise to the latent image pattern to develop the pattern.

Conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

A transfer station 46 as is also well known is provided for moving a receiver sheet "S" into engagement with the photoconductive belt in register with the image for transferring the image to a receiver. Alternatively, an intermediate member may have the image transferred to it and the image may then be transferred to the receiver. A cleaning station 48 is also provided subsequent to the transfer station for removing toner from the belt 18 to allow reuse of the surface for forming additional images. In lieu of a belt, a drum photoconductor or other image supporting structure may be used.

In the present invention, the image supporting structure is endless, such that all portions around the circumference advance, in turn, through the cycle of workstations in the machine. Examples of such endless supporting structures are flexible belts in the form of a belt, and cylindrical drums. After transfer of the unfixed toner images to a receiver sheet, such sheet is detacked from the belt and transported to a fuser station 49 where the image is fixed.

The logic and control unit provides overall control of the apparatus and its various subsystems as is well known. Programming commercially available microprocessors is a conventional skill well understood in the art.

Figure 2:
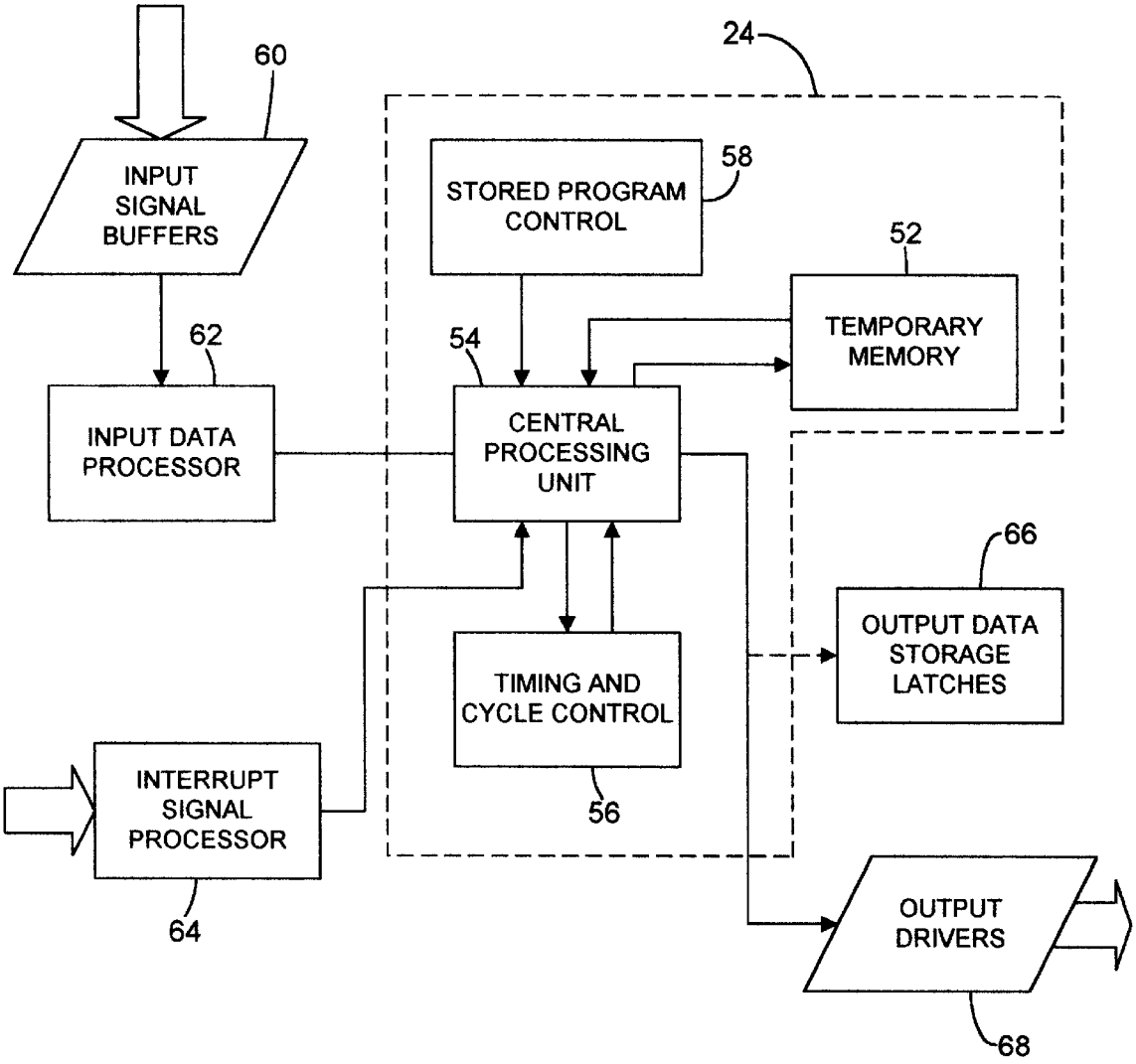
FIG. 2 is a block diagram of a logic and control unit for controlling the apparatus of FIG. 1.

Referring to FIG. 2, a block diagram of a typical logic and control unit 24 is shown. The logic and control unit comprises temporary data storage memory 52, central processing unit 54, timing and cycle control unit 56, and stored program control 58. Data input and output is performed sequentially through or under program control. Input data are applied either through input signal buffers 60 to an input data processor 62 or through an interrupt signal processor 64. The input signals are derived from various switches, sensors, and the A/D converters that are part of the apparatus 10 or received from sources external to machine 10.

The output data and control signals are applied directly or through storage latches 66 to suitable output drivers 68. The output drivers are connected to appropriate subsystems.

Process control strategies generally utilize sensors to provide real-time control of the electrostatographic process and to provide "constant" image quality output from the user's perspective.

Referring again to FIG. 1, one such sensor for process control may be a densitometer 76 to monitor development of test patches in non-image areas of photoconductive belt 18, as is well known in the art. See for example U.S. Pat. No. 5,649,266 to Rushing. The densitometer measurements are needed to insure that the transmission or reflection density of toned areas on the belt is maintained. The densitometer may include a visible or infrared light-emitting diode (LED) 77 which shines light through the belt or reflected by the belt onto a photodiode detector 82, which is connected to a densitometer circuit 80. The photodiode detector may be separate from the densitometer circuit, as shown in FIG. 1, or may be on the same circuit board as the densitometer circuit components.

For a transmission densitometer, LED 77 may be on the untoned side of belt 18 and detector 82 on the toned side, as shown in FIG. 1. Alternatively, the reverse arrangement is also workable. For a reflection densitometer, the emitter and detector would both be on the toned side of the belt. The photodiode detector generates an electrical signal that varies directly with the flux of light received. The densitometer circuit converts the detector signal to a density value.

A rotary encoder 126 engaging belt 18 outputs logic pulses corresponding to the motion of the belt. The pulse output enables the densitometer 76 to collect density readings synchronously with the belt motion. The pulse output is also connected to LCU 24 for the purpose of synchronizing the operation of the various workstations. A "SYNC" pulse motion sensor 128 outputs a SYNC pulse, preferably only one for each belt once-around, to provide an indication of the absolute position of belt 18.

In the case of transmission density, the total, or gross, measured density value is reduced by the density value of a bare untoned patch, to obtain a value $D_{NET}$, representative of the net toner density. The net signal is also representative of the thickness of the toner deposit averaged over the measured area, and also representative of the toner mass per unit area. The $D_{NET}$ signal may be used to adjust process parameters $V_0$, $E_0$, or $V_B$.

The $D_{NET}$ signal may also be used to assist in the maintenance of the proper concentration of toner particles in the developer mixture by having the logic and control unit provide control signals to a replenisher motor control 43. Replenisher motor control 43 controls replenisher motor 41 that in turn drives a toner auger 39 for feeding new toner particles into development station 38. A toner concentration monitor probe 57 provides signals to the logic and control unit about relative concentration of toner particles to carrier particles in the developer mix.

Another sensor useful for monitoring process parameters is an electrometer probe 50 which is mounted at a location preferably downstream of corona charging station 28, relative to the direction of the movement of belt 18. In FIG. 1 electrometer probe 50 is mounted immediately downstream of writehead 35.

II. A Preferred Densitometer Embodiment

Figure 3:
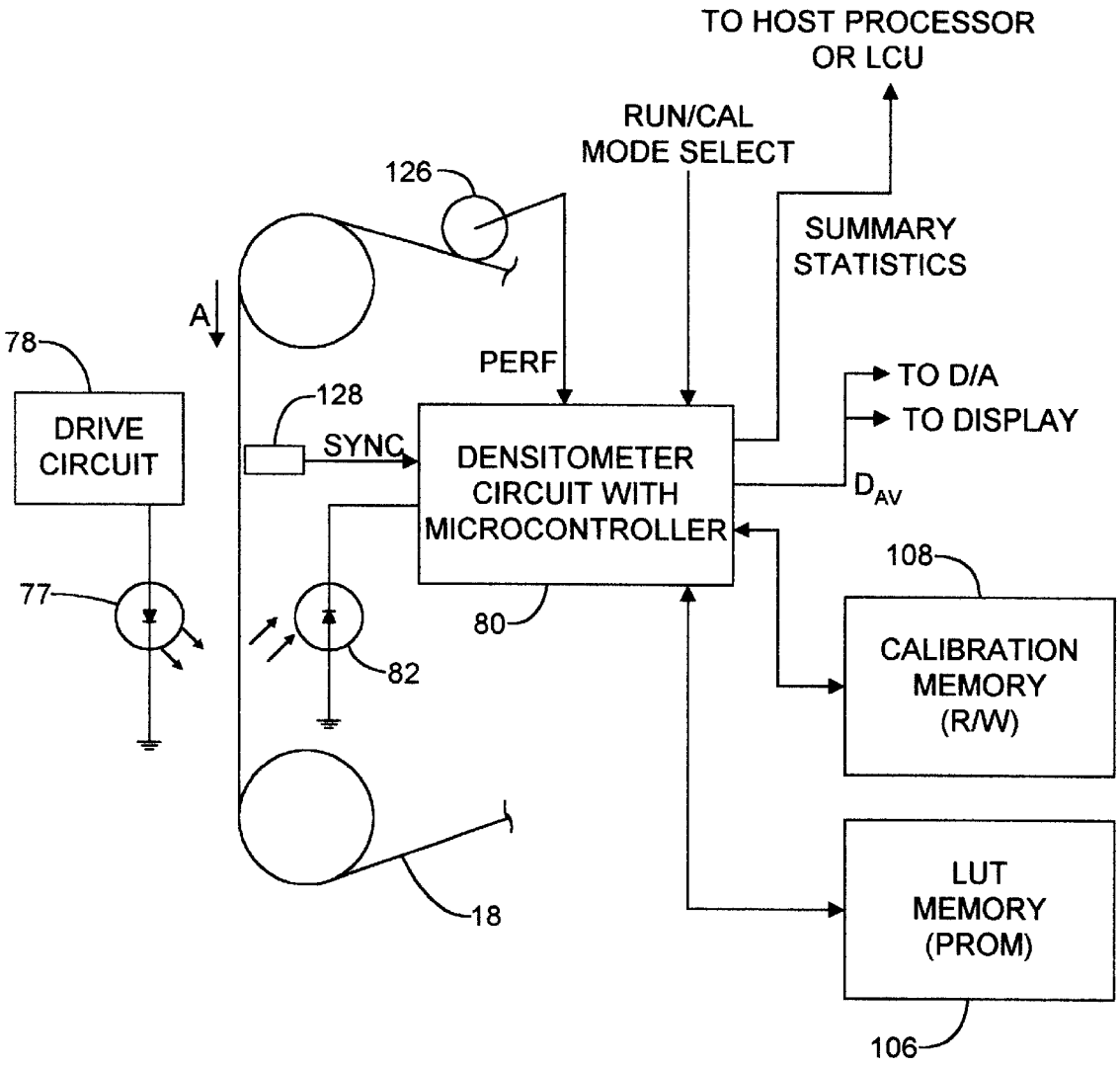
FIG. 3 is a block diagram of a densitometer incorporated within a copier/printer according to a preferred embodiment of the present invention.

With reference to FIG. 3, a block diagram for a currently preferred embodiment of the present invention is shown incorporated within a copier/printer. Endless image supporting structure 18, moveable in the direction indicated by arrow "A", may be in the form of a belt, a portion of which is shown. Alternatively, the supporting structure may be the form of a rotating drum. A first motion sensor is preferably a rotary encoder 126, but any encoder outputting a signal synchronous with the motion of the image supporting structure may be used. The rotary encoder is coupled to belt 18, either directly, as shown, or through one of the entraining rollers.

Encoder 126 generates pulses with a frequency proportional to the belt velocity. In the preferred embodiment of FIG. 3, encoder 126 is coupled to belt 18, through perforations in the belt engaging the teeth of a gear wheel on the shaft of the encoder. The encoder pulse output is therefore referred to hereinafter as a "PERF" signal, even though the encoder pulse frequency may be different from the actual perforation frequency.

A second motion sensor 128 is shown in FIG. 3 as a reference mark detector. Motion sensor 128 detects reference marks as they pass on moving belt 18, and produces a SYNC pulse whenever a reference mark moves past. Alternatively, another type of motion sensor, not shown, outputs both a PERF signal and a SYNC signal, from a single module. The reference mark on the belt or drum may be of any type detectable by a sensor, such as optical, mechanical, or magnetic sensors. A rectangular hole or slot in the belt is a preferred type of reference mark, detectable by an optical sensor. Preferably there is only a single reference mark, which passes the detector repeatedly, producing a single pulse per once-around, while the belt or drum is in motion. If multiple reference marks are used, they are preferably equally spaced around the belt or drum circumference.

Yet another type of encoder generates a SYNC pulse directly from the encoder's own rotation, rather than from sensing a reference mark on the endless belt or drum. In this case, the encoder must be coupled to the belt or drum such that the occurrence of the SYNC pulse corresponds to a specific belt or drum position or positions.

In FIG. 3, the PERF sensing rotary encoder 126, SYNC sensor 128, and densitometer photodiode detector 82 are shown in separate positions, beginning with the PERF sensor in the most upstream position, followed by the SYNC sensor, and then the photodiode detector. The positions shown in FIG. 3 are illustrative only, and do not preclude other positions in other embodiments. A space-saving configuration could have two of these sensors, or even all three, located at substantially the same circumferential position, on the same circuit board.

In the preferred embodiment there are, normally, a predetermined number of PERF pulses occurring between successive SYNC pulses as the belt advances. A densitometer circuit 80 receives both PERF and SYNC signals. The SYNC pulses provide a reference signal, corresponding to a specific reference position of the endless belt or drum. The count of PERF pulses since the last SYNC pulse defines a position around the circumference of the endless belt or drum. In the preferred embodiment, a microcontroller, such as Microchip Corporation model PIC16C622, keeps count of PERF and SYNC pulses, so that density readings can be associated with specific positions around the belt circumference.

The SYNC pulses also function to reset the counting of PERF pulses, and correct for any missing or extraneous PERF pulses due to noise or malfunction. Without such a periodic reset, the positional error associated with missing or extraneous PERF pulses, caused by electrical noise, for example, would build up cumulatively.

With continuing reference to FIG. 3, a drive circuit 78 energizes LED 77, in either a continuous mode, or a pulse mode. A transmissive densitometer mode is shown, wherein a portion of the light emitted from LED 77 is transmitted through belt 18, and incident on photodiode 82. A signal from photodiode 82 characteristic of the incident light is connected to densitometer circuit 80. Alternatively, a reflective densitometer arrangement could be used.

A command input designated "RUN/CAL" is connected to densitometer circuit 80. The RUN/CAL signal may come from a manual switch, or from a host processor. The densitometer circuit operates in either the "RUN" mode or the "calibrate" ("CAL") mode, according to the RUN/CAL command input.

A read-write memory 108, preferably of the electrically erasable programmable read-only memory (EEPROM) type is provided, enabling densitometer circuit 80 to store and retrieve calibration density data. If the memory within the microcontroller of densitometer circuit 80 is insufficient for all other required tasks, such as calculating summary statistics, read-write memory 108 can also provide memory to supplement the microcontroller memory. LUT 106, contained in a programmable read-only memory (PROM) type of memory, contains a pre-loaded density lookup table. The EEPROM and PROM memory interfaces are preferably of the serial type to minimize the number of input/output connections, but a parallel type could also be used.

With continuing reference to FIG. 3, the current net density moving average ($D_{AV}$), is output from densitometer circuit 80 to a display device and to a digital-to-analog (D/A) converter. Summary statistics of the latest block of density readings are output to a host processor or LCU. These outputs or others would be used in various combinations, according to the needs of the application.

Figure 4:
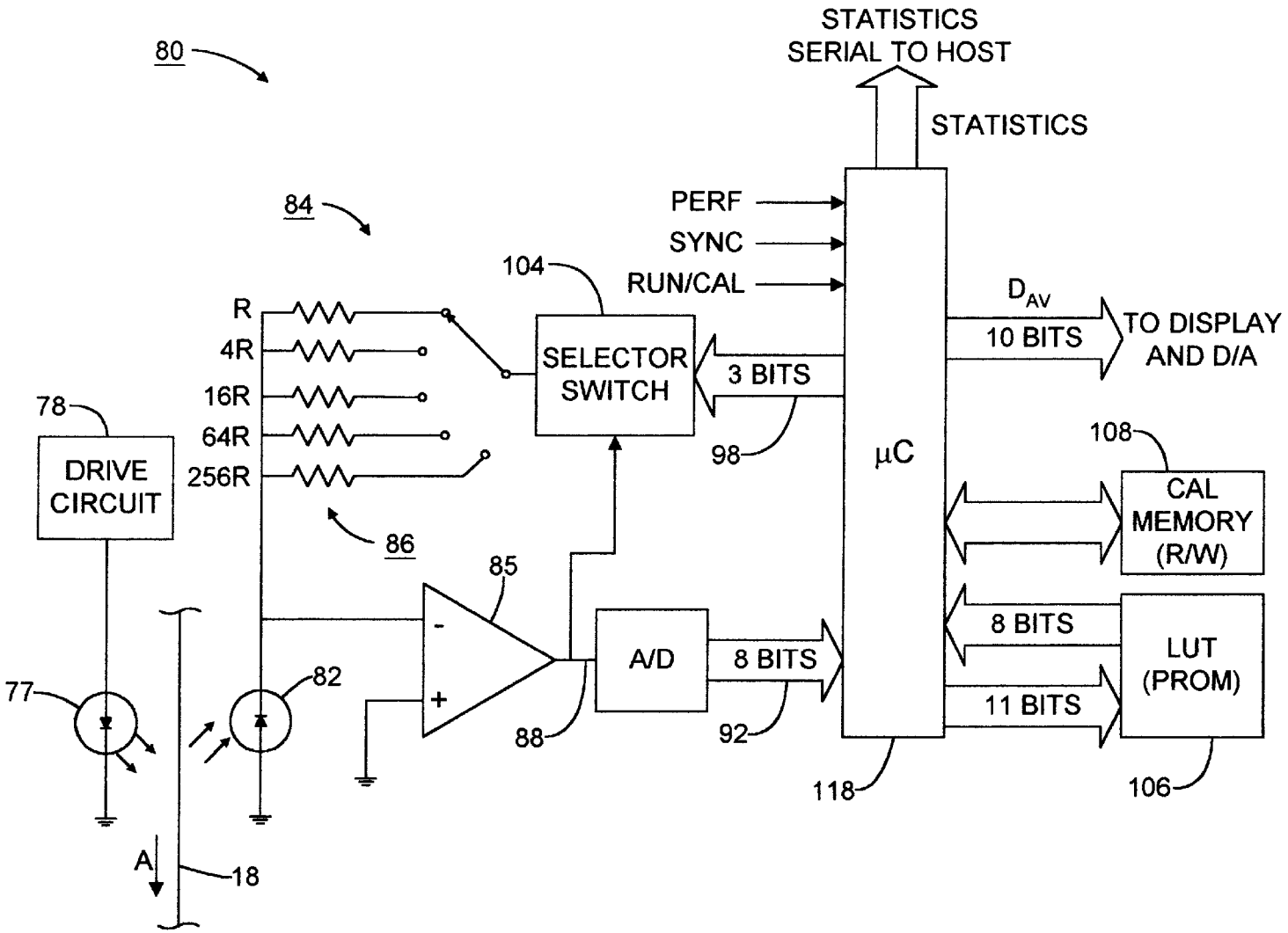
FIG. 4 is a more detailed block diagram of the densitometer circuit in a preferred embodiment.

Turning now to FIG. 4, a more detailed block diagram of densitometer circuit 80 in the preferred embodiment is shown. Drive circuit 78 energizes LED 77, in either a continuous mode, or a pulse mode. A transmissive densitometer mode is shown, wherein a portion of the light emitted from LED 77 is transmitted through belt 18, and incident on photodiode 82. Photodiode 82 provides a photocurrent signal into an amplifier 84. A variable feedback resistor system 86 around operational amplifier 85 provides a determinable gain so that the amplifier output voltage signal 88 is proportional to the photocurrent in photodiode 82. Feedback resistor system 86 is programmed in real-time through an analog selector switch 104 to accommodate a wide range of light intensities, as explained hereinafter: Amplifier output 88 is connected to an A/D converter 90 to produce an A/D output signal 92 of eight bits. An A/D converter with a parallel output is preferred, but a serial output A/D could also be used.

The 8-bit value of A/D output signal 92 is input to a microcontroller 118. The microcontroller is programmed to select a gain and output a 3-bit gain code 98. The 3-bit gain code is input to analog switch 104 to select one of five gain resistors of variable feedback resistor system 86 to provide a high level of sensitivity without saturation. The microcontroller is programmed to change the gain as necessary to maintain the A/D output in the range between ¼ full-scale and full-scale (saturated). By using a programmable gain, good densitometer resolution is attained over a large range of densities.

The five amplifier gain resistors of feedback resistor system 86 increase in value, one to the next, in a ratio of 4.00:1. The corresponding range of transmittance or reflectance that can be measured is $4^5$:1=1024:1, corresponding to a density range of $\log_{10}(1024)$ or approximately 3.0 density units. This density range is scaled to integers from 0 to 255 for purposes of pre-loading, or "populating" LUT 106. This scaled density range is divided equally among the 5 gains, for 51 distinct scaled density values for each gain.

With continuing reference to FIG. 4, an 11-bit LUT address is output serially from microcontroller 118 to LUT 106. The lower-order 8 bits are set to match the A/D converter output 92, and the remaining 3 higher-order address bits are set according to the 3-bit gain code 98. When LUT 106 receives the read command and address from microcontroller 118, it returns the scaled density value contained at that address to the microcontroller.

With five gains and an 8-bit (256-value) A/D output, a LUT with 5*256=1280 entries is more than sufficient, since A/D outputs below 64 (¼ full-scale) are not used. Memory storage for a LUT of this size is easily within the capacity of a single low-cost PROM integrated circuit chip. The LUT is pre-loaded with the scaled density values according to the amplifier gain and the A/D output. Every integer scaled density value from 0 to 255 is contained in at least one LUT entry, so there are no skipped values, giving true 8-bit density resolution.

During the CAL mode, belt 18 passes photodiode 82 without any applied marking material, such as toner. Normal imaging operations, particularly toning, are suspended for the CAL mode, so that the bare uncovered support material is presented to the densitometer. The densitometer reads the density values for the bare support. This bare support density may be nonuniform around the belt or drum circumference, as read in the spots defined by the PERF and SYNC signals. An entire array of bare support density values, characterizing spot-by-spot the entire circumference of the support, are stored in read-write memory 108 for later use during the RUN mode. From time to time, the CAL mode operation is repeated to update the bare support density values, or reference density values, which may change owing to wear, scum formation, or contamination, for example.

In a simplified alternative CAL mode operation, bare support reference values may be obtained in only one or a few spots, rather than over the entire circumference. The advantage is that there is no need to disable toning for the entire circumference. In some cases, representative reference values may be obtained from the bare support in the interframe areas during normal imaging. The bare support density is characterized quickly and with only a few measurements, though not in spot-by-spot detail over the entire circumference. All spots on the support are represented by reference values obtained at just one or a few representative spots. A further advantage is that much less memory is required; a single register within microcontroller 118 would suffice for a single reference value. Separate read-write memory 108 would not then be needed for this purpose. This simplified alternative is most effective when the support, by virtue of its material characteristics and manufacture, is reliably uniform in density, though not necessarily constant over time, even after long use and aging. For such supports, one or a few reference values, updated from time to time, provide a good characterization of the entire support circumference.

During the RUN mode, after microcontroller 118 obtains a "raw" density value from LUT 106, the microcontroller computes a corrected density value. The corrected value is obtained by retrieving the previously stored reference density value, and subtracting it from the "raw" density value. The difference is the corrected value. The corrected value may be interpreted as a "net" density value, characteristic of the marking material density above the "base" reference density value of the belt, i.e., above the bare support density. In the subtraction, timing derived from the PERF and SYNC inputs enable microcontroller 118 to work with "raw" and "base" density values representing the same spot on the belt, yielding a "net" density valid for that spot.

Ideally, the support layer and the marking material are additive in density, i.e., the composite density is the sum of the individual densities. Many practical photoconductor belts and toner materials come reasonably close to this ideal of additivity, especially for transmission density. When this is so, the subtractive correction described hereinbefore provides a valid net toner density, corrected for support density nonuniformity and variability over time.

With continuing reference to FIG. 4, microcontroller 118 computes statistics, such as average net density, maximum, and minimum, for the most recently completed block sequence (say, several hundred) of density readings between SYNC pulses. The statistical results are output by a serial connection to a host computer or display device. When the next block sequence of density readings is available, updated statistics are computed and output to the host or display device.

The microcontroller in FIG. 4 also computes, for every new density reading, a moving average of the N most recently read density values, to filter and suppress the influence of noise. For a given noise level in the individual readings, superimposed on a constant density input, the exactly computed average of N digital readings typically has a standard deviation reduced by a factor as large as $N^{1/2}$, compared to the standard deviation of the individual readings. This increases the number of statistically significant bits in the average, compared to the individual readings.

For example, consider the individual density readings output from LUT 106 of FIG. 4. The scaled density values stored in the LUT have 8 bits, limiting the individual density readings to 8 significant bits, if noise levels are low enough. If noise levels are higher, random reading-to-reading fluctuations appear in one or more of the least significant bits, to the point that they become statistically insignificant. Averaging a sufficient number of individual readings can restore bit significance, even beyond the maximum of 8 significant bits of the individual readings.

Obtaining the full resolution improvement possible with averaging may therefore require computing and outputting an average with more bits than the individual readings. The preferred embodiment of FIG. 4 computes and outputs a 10-bit moving average $D_{AV}$ of N=16 individual 8-bit scaled density readings. The moving average $D_{AV}$ is output to a display device and, for process control purposes, to a digital-to-analog (D/A) converter. Microcontroller 118 stores the latest N density readings in memory. When a new reading is obtained, the oldest is discarded, and the moving average is updated and output.

The tradeoff in obtaining the aforementioned improvement in density resolution is a loss in spatial resolution. However, electrophotographic process control typically relies on measurements of process control patches, intended to be uniform in density. These patches are large enough to provide several individual patch readings (at least 16 required in this preferred embodiment) for averaging, as the patch passes the densitometer. High spatial resolution within the uniform process control patches and at their edges is often not needed.

The microcontroller can also be programmed to provide more specialized or sophisticated measurement data processing. For example, the density values for the measured spots entered into the average calculation may have unequal weighting, such as weighting according to the proximity of each spot to the latest spot read.

A useful variation of such moving average algorithms is to delay the averaging for a spot until readings both preceding and following that spot are available for the calculation, yielding a "smoothed", as opposed to a "filtered" value. The extra readings entering into the smoothed output provide more noise suppression, and elimination of phase lag, compared to the filtered output.

Other types of filtering algorithms are also available, such as recursive types. In a simple recursive filter the new updated output value is a weighted average of the previous updated output value and the latest measurement. An advantage of the recursive type is that no memory is required for previous density readings. However, in the recursive type the influence in the filter output of any one reading diminishes gradually (approximately exponentially) over time, rather than abruptly. This can be a disadvantage when reading process control patches, in that the filter output is somewhat influenced by density readings from outside the patch.

Depending upon the measurement requirements, and the noise characteristics of both the imaging process and the measurement process, various known filtering and smoothing algorithms may be useful. Such algorithms can be readily programmed into the microcontroller of the preferred densitometer embodiment, and thereby reduce the computational burden on the host processor.

Another useful type of measurement data processing is to identify image patterns, and signal their presence and characteristics to the host processor. One example class of patterns is edges between high-density and low-density areas. Another simple class of patterns is lines. Edges or lines can be used to monitor image registration and skew. Line recognition is also useful in locating the seam in an endless belt. Yet another class of patterns useful to identify is the "flat pattern", where sequential measurements are at any density level, but unvarying. Such a pattern is characteristic of a belt or drum that is motionless, such that the same spot is measured repeatedly. A signal indicating no motion can be used to turn the densitometer emitter off, or switch to an extremely low pulse duty-cycle, to avoid harmful and needless exposure. Other more complex pattern classes can also be identified and signaled. Known pattern recognition and image evaluation algorithms can be readily programmed into the microcontroller of the preferred densitometer embodiment, and reduce the burden on the host processor.

We turn now to a more detailed discussion of the "flat pattern" for inferred motion detection. When the web or drum is in motion, normal nonuniformity in marking material coverage across the image areas causes the density measurements to vary greatly. Even a perfectly uniform density on the moving web or drum will not yield a perfectly unvarying density measurement, owing to various noise sources associated with the motion. Examples of such noise sources could include web flutter or drum runout at the densitometer, and noise coupled into the densitometer from the various drives and workstations operating while the support is in motion. A belt will typically have density nonuniformity in the region of a seam, sufficient for inferring motion as the seam passes the densitometer. However, when the web or drum is stopped, between print jobs for example, sequential density measurements are from a single spot. Whether the spot is toned or untoned, the density readings are substantially unvarying. The noise sources present during motion are largely absent.

Density variation can be numerically characterized and calculated in terms of, for example, standard deviation or range (maximum minus minimum). The range calculation simply requires saving the maximum and minimum measurements collected over a defined period of time or a defined number of measurements, and then subtracting the minimum from the maximum. A range less than a predetermined threshold, over a defined time period, indicates that motion has stopped. The range measurements and calculations can be periodically updated; to indicate when motion resumes, as when the next print job is begun.

In some cases, reliability of the inferred motion signal may be improved by using hysteresis, with two threshold values for variability. Variability exceeding the higher threshold would trigger a reliable "motion resumed" indication, while variability less than the lower threshold would trigger a reliable "motion stopped" indication. Variability between the two thresholds, where motion may or may not be present, would not trigger possibly false or unreliable indications of changed motion status. A microcontroller, such as Microchip Corporation model PIC16C715, within the densitometer circuit can be programmed to compute density variation in terms of range or in other variation terms, and produce an inferred motion signal.

Figure 5:
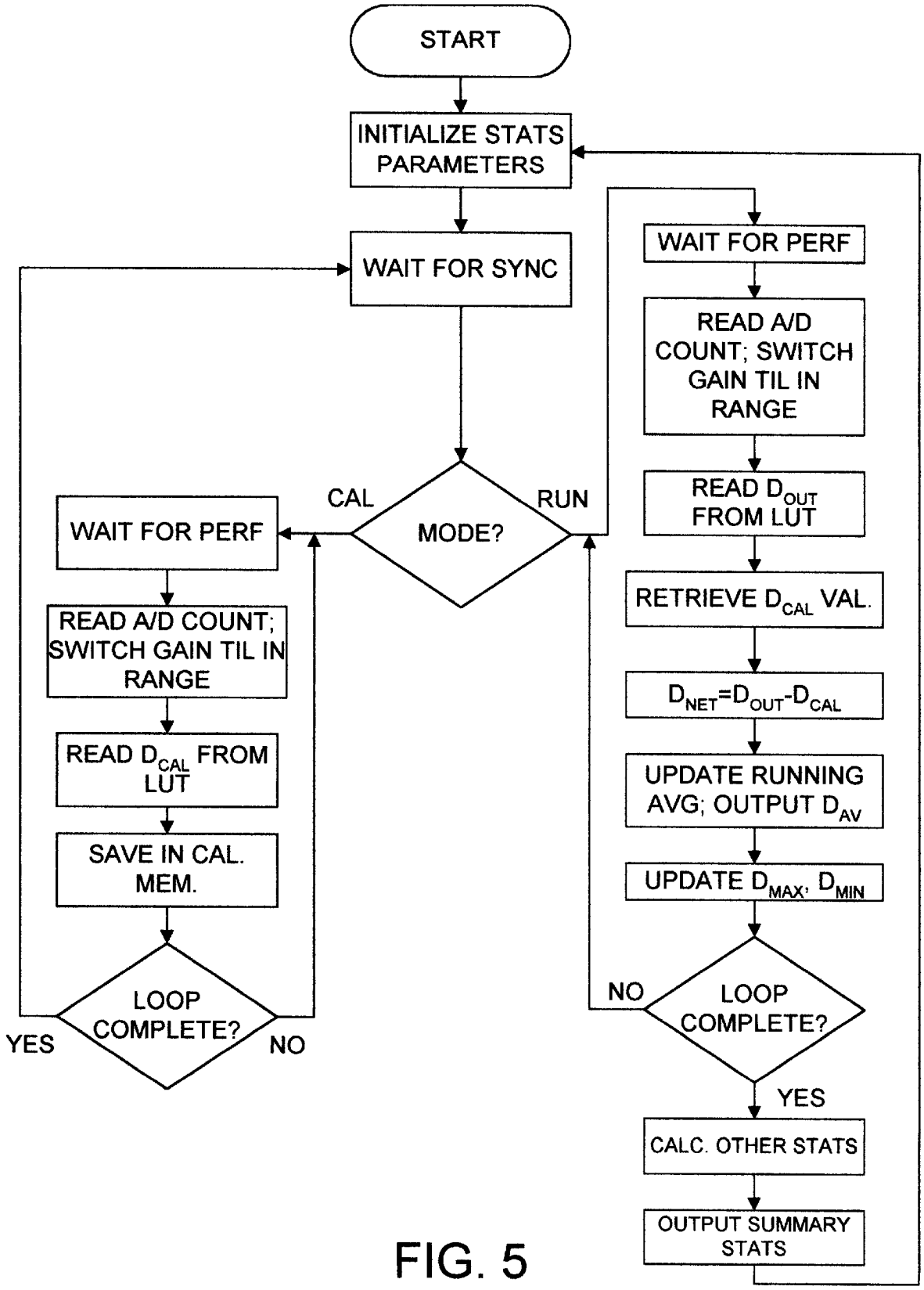
FIG. 5 is a program flowchart for the microcontroller ($\mu$C) of the preferred embodiment.

Turning now to FIG. 5, the microcontroller program flowchart is shown for the preferred embodiment. The first step is to set initial values for certain parameters entering into the statistical calculations. These include initial "placeholder" values for maximum and minimum density values, and initial zero values for cumulative density summations, for use in computing average values. The SYNC pulse signals the program to begin collecting density data, PERF-by-PERF, at defined spots on the belt, in either the CAL mode or the RUN mode.

During the CAL mode the copier/printer is normally operated without applying marking material, so that the density readings represent the bare support. The CAL readings are saved in memory for later use during the RUN mode operation.

During the RUN mode the copier/printer is normally operated to apply the image marking material such as toner. The density readings obtained represent the sum of the bare support density and the toner density. The bare support density values previously stored in the CAL mode are subtracted, PERF-by-PERF, to obtain net toner density $D_{NET}$ values. A moving average of the $D_{NET}$ values filters out noise, yielding $D_{AV}$ values. The $D_{AV}$ values are output for process monitoring and process control purposes. When an entire set of density values has been collected for a full belt cycle, summary statistics are computed for output or display.

For setup, diagnostic, or troubleshooting purposes, density values can be collected from large unimaged areas, or large uniformly toned areas—even around the entire belt or drum. Statistics can be computed to evaluate deviations from the ideal uniformity. For normal image production, density values from smaller interframe process control patches would be particularly important in a process control algorithm.

CONCLUSION, RAMIFICATIONS, AND SCOPE

A densitometer with specialized timing and built-in data processing capability has been disclosed. A presently preferred embodiment has been described illustrating several advantages. Synchronizing signals are used to collect data at defined spots on a moving endless belt or drum. Calibration procedures null out a nonuniform and time-variable base density, and thereby correct for coating variability, wear, scum formation, contamination, and the like. Data averaging, filtering, and smoothing within the densitometer enable more accurate and noise-immune process control. Summary statistics and pattern recognition are automatically computed for evaluation or diagnostic purposes. Performing this data processing on the densitometer circuit board unburdens the host processor or LCU, so that its hardware and software can better attend to higher-level machine control functions.

The invention has been described in detail with particular reference to a presently preferred embodiment thereof, but it will be understood that variations and modifications can be effected within the spirit and scope of the invention. It will also be recognized that the present invention may be used in other applications besides electrophotographic copies and printers.

What is claimed is:

1. A densitometer for determining the optical density of a test sample, wherein said test sample is in the form of marking material on an endless supporting structure, and said test sample is at least sometimes in lateral motion advancing past said densitometer, said densitometer comprising:

a photodetector;

means to convert the output of said photodetector and provide a density output characteristic of the density of said test sample;

means to receive encoder pulses, said encoder pulses being synchronous with the motion of said test sample, wherein said encoder pulses trigger the updating of said density output;

means to receive a sync pulse signal signifying the passage of a reference mark on said endless supporting structure past a sensor, whereby a predetermined number of said encoder pulses are received between successive said sync pulses while said endless supporting structure advances; and storage means for saving at least one of said density outputs;

wherein during a run mode of operation, said sync pulse signal marks the beginning of a sequence of said density outputs, whereby said density outputs correspond respectively to successive defined spots on said test sample; and wherein during a calibrate mode of operation, said sync pulse marks the beginning of a reference sequence of at least one of said density outputs, and said reference sequence values are saved in said storage means, whereby reference density values can be retrieved at a later time.

2. A densitometer as set forth in claim 1, and further including means operable during said run mode for retrieving and subtracting a reference density value stored previously while in said calibrate mode from the value of said run mode density output, wherein both said density values represent the same one of said defined spots on said test sample, whereby a net density value is obtained.

3. A densitometer as set forth in claim 1, further including means for computing summary statistics of said density outputs obtained between two sync pulses, including at least one statistic of the group consisting of average, median, mode, maximum, minimum, standard deviation, root-mean-square, variance, and number of readings out-of-limit.

4. A densitometer as set forth in claim 2, further including means for computing summary statistics of said net density values obtained between two sync pulses, including at least one statistic of the group consisting of average, median, mode, maximum, minimum, standard deviation, root-mean-square, variance, and number of readings out-of-limit.

5. A densitometer as set forth in claim 1, wherein:

said photodetector is a photodiode;

said means to convert comprises an amplifier circuit adapted to produce an output signal proportional to the light flux incident on said photodiode, said amplifier circuit has 5 gains that increase one to the next by a ratio of 4.0 to 1, selectable by an analog switch and a 3-bit gain code, an 8-bit analog-to-digital converter inputs to a programmable microcontroller, and a lookup table comprising a programmable read-only memory with 8-bit output is addressed by an 11-bit address formed by the 8-bit output from said analog-to-digital converter and said 3-bit gain code;

said microcontroller receives said encoder pulses and said sync pulses;

said storage means is an electrically erasable programmable read-only memory for saving said density outputs; and whereby density values are read at said successive defined spots on said test sample with 8-bit resolution over a range of about 3.00 density units.

6. A densitometer as set forth in claim 1, and further including means to compute and output a moving average of said density output, wherein said moving average is computed and output with a number of binary bits at least equal to the number of binary bits in an individual reading of said density output.

7. A densitometer as set forth in claim 1, and further including means to compute and output a delayed and smoothed function of said density output, wherein said delayed and smoothed function is computed and output with a number of binary bits at least equal to the number of binary bits in an individual reading of said density output.

8. A densitometer as set forth in claim 1, and further including means to compute and output a recursively filtered function of said density output, wherein said recursively filtered function is computed and output with a number of binary bits at least equal to the number of binary bits in an individual reading of said density output.

9. A densitometer as set forth in claim 1, and further including means to recognize and signal the presence of density patterns on said test sample belonging to a predetermined class.

10. A densitometer as set forth in claim 1, and further including means to recognize and signal the presence of density patterns on said test sample belonging to a class selected from the group consisting of edges, lines, and flat or unvarying patterns.

11. A densitometer as set forth in claim 2, and further including means to compute and output a moving average of said density output, wherein said moving average is computed and output with a number of binary bits at least equal to the number of binary bits in an individual reading of said density output.

12. A densitometer as set forth in claim 2, and further including means to compute and output a delayed and smoothed function of said density output, wherein said delayed and smoothed function is computed and output with a number of binary bits at least equal to the number of binary bits in an individual reading of said density output.

13. A densitometer as set forth in claim 2, and further including means to compute and output a recursively filtered function of said density output, wherein said recursively filtered function is computed and output with a number of binary bits at least equal to the number of binary bits in an individual reading of said density output.

14. A densitometer as set forth in claim 2, and further including means to recognize and signal the presence of density patterns on said test sample belonging to a predetermined class.

15. A densitometer as set forth in claim 2, and further including means to recognize and signal the presence of density patterns on said test sample belonging to a class selected from the group consisting of edges, lines, and flat or unvarying patterns.

* * * * *